US010264345B1

(12) United States Patent
Sapozhnykov et al.

(10) Patent No.: US 10,264,345 B1
(45) Date of Patent: Apr. 16, 2019

(54) DYNAMIC ON EAR HEADSET DETECTION

(71) Applicant: Cirrus Logic International Semiconductor Ltd., Edinburgh (GB)

(72) Inventors: Vitaliy Sapozhnykov, Cremorne (AU); Thomas Ivan Harvey, Cremorne (AU); Nafiseh Erfaniansaeedi, Cremorne (AU); Robert Luke, Cremorne (AU)

(73) Assignee: Cirrus Logic, Inc., Austin, TX (US)

( * ) Notice: Subject to any disclaimer, the term of this patent is extended or adjusted under 35 U.S.C. 154(b) by 0 days.

(21) Appl. No.: 16/125,950

(22) Filed: Sep. 10, 2018

Related U.S. Application Data

(60) Provisional application No. 62/570,352, filed on Oct. 10, 2017.

(51) Int. Cl.

| | |
|---|---|
| ***H04R 1/10*** | (2006.01) |
| ***H04R 1/40*** | (2006.01) |
| ***H04R 3/00*** | (2006.01) |
| ***H04R 29/00*** | (2006.01) |
| *G10K 11/178* | (2006.01) |

(52) U.S. Cl.
CPC ..... *H04R 1/1041* (2013.01); *H04R 1/1008* (2013.01); *H04R 1/1016* (2013.01); *H04R 1/406* (2013.01); *H04R 3/005* (2013.01); *H04R 29/001* (2013.01); *G10K 11/17823* (2018.01); *G10K 2210/1081* (2013.01); *G10K 2210/3043* (2013.01); *G10K 2210/3046* (2013.01); *H04R 2420/07* (2013.01)

(58) Field of Classification Search
CPC ..... H04R 1/10
See application file for complete search history.

(56) References Cited

U.S. PATENT DOCUMENTS

| | | | | |
|---|---|---|---|---|
| 9,838,812 | B1 * | 12/2017 | Shetye | H04R 29/001 |
| 9,894,452 | B1 * | 2/2018 | Termeulen | H04R 29/001 |
| 2017/0013345 | A1 * | 1/2017 | Kumar | G10K 11/178 |

FOREIGN PATENT DOCUMENTS

| | | | |
|---|---|---|---|
| WO | 2017200679 | A1 | 11/2017 |
| WO | 2018081154 | A1 | 5/2018 |

* cited by examiner

*Primary Examiner* — Olisa Anwah
(74) *Attorney, Agent, or Firm* — Jackson Walker L.L.P.

(57) ABSTRACT

A method and device for detecting whether a headset is on ear. Microphone signals from a plurality of microphones are used to derive a plurality of signal feature measures, which are normalized to a common reference scale. The signal feature measures are weighted based upon detected signal conditions in the microphone signals. The normalized and variably weighted signal feature measures are then combined to produce an output indication of whether a headset is on ear.

21 Claims, 5 Drawing Sheets

DYNAMIC ON EAR HEADSET DETECTION

This application claims priority to U.S. Provisional Patent Application Ser. No. 62/570,352, filed Oct. 10, 2017, which is incorporated by reference herein in its entirety.

FIELD OF THE INVENTION

The present invention relates to headsets, and in particular to a headset configured to determine whether or not the headset is in place on or in the ear of a user, and a method for making such a determination.

BACKGROUND OF THE INVENTION

Headsets are a popular device for delivering sound to one or both ears of a user, such as playback of music or audio files or telephony signals. Headsets typically also capture sound from the surrounding environment, such as the user's voice for voice recording or telephony, or background noise signals to be used to enhance signal processing by the device. Headsets can provide a wide range of signal processing functions.

For example, one such function is Active Noise Cancellation (ANC, also known as active noise control) which combines a noise cancelling signal with a playback signal and outputs the combined signal via a speaker, so that the noise cancelling signal component acoustically cancels ambient noise and the user only or primarily hears the playback signal of interest. ANC processing typically takes as inputs an ambient noise signal provided by a reference (feed-forward) microphone, and a playback signal provided by an error (feed-back) microphone. ANC processing consumes appreciable power continuously, even if the headset is taken off.

Thus in ANC, and similarly in many other signal processing functions of a headset, it is desirable to have knowledge of whether the headset is being worn at any particular time. For example, it is desirable to know whether on-ear headsets are placed on or over the pinna(e) of the user, and whether earbud headsets have been placed within the ear canal(s) or concha(e) of the user. Both such use cases are referred to herein as the respective headset being "on ear". The unused state, such as when a headset is carried around the user's neck or removed entirely, is referred to herein as being "off ear".

Previous approaches to on ear detection include the use of dedicated sensors such as capacitive, optical or infrared sensors, which can detect when the headset is brought onto or close to the ear. However, to provide such non-acoustic sensors adds hardware cost and adds to power consumption. Another previous approach to on ear detection is to provide a sense microphone positioned to detect acoustic sound inside the headset when worn, on the basis that acoustic reverberation inside the ear canal and/or pinna will cause a detectable rise in power of the sense microphone signal as compared to when the headset is not on ear. However, the sense microphone signal power can be affected by noise sources such as wind noise, and so this approach can output a false positive that the headset is on ear when in fact the headset is off ear and affected by noise. These and other approaches to on ear detection can also output false positives when the headset is held in the user's hand, placed in a box, or the like.

Any discussion of documents, acts, materials, devices, articles or the like which has been included in the present specification is solely for the purpose of providing a context for the present invention. It is not to be taken as an admission that any or all of these matters form part of the prior art base or were common general knowledge in the field relevant to the present invention as it existed before the priority date of each claim of this application.

Throughout this specification the word "comprise", or variations such as "comprises" or "comprising", will be understood to imply the inclusion of a stated element, integer or step, or group of elements, integers or steps, but not the exclusion of any other element, integer or step, or group of elements, integers or steps.

In this specification, a statement that an element may be "at least one of" a list of options is to be understood that the element may be any one of the listed options, or may be any combination of two or more of the listed options.

SUMMARY OF THE INVENTION

A signal processing device for on ear detection for a headset, the device comprising:

a plurality of inputs for receiving respective microphone signals from a plurality of microphones; and a processor configured to derive from the microphone signals a plurality of signal feature measures, the processor further configured to normalise the signal feature measures; the processor further configured to variably weight the signal feature measures in response to detected signal conditions in the microphone signals; the processor further configured to combine the variably weighted normalized signal feature measures to produce an output indication of whether a headset is on ear.

A method for on ear detection for a headset, the method comprising:

receiving respective microphone signals from a plurality of microphones;

deriving from the microphone signals a plurality of signal feature measures;

normalising the signal feature measures;

variably weighting the signal feature measures in response to detected signal conditions in the microphone signals; and combining the variably weighted normalized signal feature measures to produce an output indication of whether a headset is on ear.

A non-transitory computer readable medium for on ear detection for a headset, comprising instructions which, when executed by one or more processors, causes performance of the following:

receiving respective microphone signals from a plurality of microphones;

deriving from the microphone signals a plurality of signal feature measures;

normalising the signal feature measures;

variably weighting the signal feature measures in response to detected environmental conditions in the microphone signals; and combining the variably weighted normalized signal feature measures to produce an output indication of whether a headset is on ear.

A system for on ear detection for a headset, the system comprising a processor and a memory, the memory containing instructions executable by the processor and wherein the system is operative to:

receive respective microphone signals from a plurality of microphones;

derive from the microphone signals a plurality of signal feature measures;

normalise the signal feature measures;

variably weight the signal feature measures in response to detected signal conditions in the microphone signals; and combine the variably weighted normalized signal feature measures to produce an output indication of whether a headset is on ear.

In some embodiments of the invention, the detected signal conditions comprise signal presence indicators respectively indicating whether a signal is present on the microphone signals.

In some embodiments of the invention the processor is configured to normalise the signal feature measures by applying a non-linear mapping of each signal feature measure to a unitless reference scale. The non-linear mapping could for example comprise a sigmoid function or a piecewise linear function. The unitless reference scale in some embodiments outputs a value between 0 and 1, inclusive, while in other embodiments may output a value between −1 and 1, inclusive.

The plurality of signal feature measures in some embodiments may comprise a signal feature reflecting passive loss, being the attenuation in an external sound level. In some embodiments of the invention, greater weight is given to the normalized passive loss signal feature measure when playback is quiet and ambient noise is not quiet.

Additionally or alternatively, the plurality of signal feature measures in some embodiments may comprise a signal feature reflecting occlusion gain, being the increase in sound level which occurs when the earbud is on ear. In some embodiments of the invention, greater weight is given to the normalized occlusion gain signal feature measure when playback is not quiet and ambient noise is quiet.

In some embodiments of the invention, the processor is configured to create an inaudible acoustic probe signal for playback. For example, a memory storage may be provided, storing data which defines a plurality of distinct probe signals, each probe signal corresponding to a respective detected signal condition. The plurality of signal feature measures may comprise a signal feature reflecting probe amplitude, being the observed amplitude of the inaudible probe signal when played back. An amplitude of the probe signal may be estimated by state estimation. In some embodiments of the invention, greater weight is given to the normalized probe amplitude signal feature measure when playback and ambient noise are quiet.

In some embodiments of the invention a control module is configured to select a weighting to be applied to the signal feature measures based on the detected signal conditions in the microphone signals. In some embodiments of the invention a memory storage is provided, storing predefined signal feature weightings to be applied to the signal features measures, each predefined signal feature weighting corresponding to a respective detected signal condition.

In some embodiments of the invention a linear combiner is provided, for multiplying the signal feature measures by respective variable weights. In some embodiments the linear combiner is further configured to produce a soft decision whether a headset is on ear by summing the products of the signal feature measures with the respective variable weights.

In some embodiments of the invention, at least one signal processing function of the device is altered in response to a determination that the headset is not on ear. For example the signal processing function might be active noise cancellation (ANC), and the ANC might be disabled when the headset is not on ear. The plurality of microphones in some embodiments might comprise an error microphone and a reference microphone, wherein the respective microphone signals from the error microphone and the reference microphone are further used to implement the active noise cancellation.

The output indication of whether a headset is on ear in some embodiments is a soft decision representing a probability that the headset is on ear. The output indication of whether a headset is on ear in some embodiments is a hard binary decision.

In some embodiments of the invention the processor is configured to normalise the signal features before variably weighting the signal feature measures. In some embodiments of the invention the processor is configured to normalise the signal features simultaneously with or after variably weighting the signal feature measures.

In some embodiments of the invention the processor is further configured to statically weight at least one signal feature measure, and the statically weighted signal feature measure is also combined with the variably weighted normalized signal feature measures to produce the output indication of whether a headset is on ear. In some embodiments of the invention the processor is configured to statically weight at least one signal feature measure in accordance with a user input. In some embodiments of the invention the processor is configured to statically weight at least one signal feature measure by a fixed proportion, or by an averaging step.

BRIEF DESCRIPTION OF THE DRAWINGS

An example of the invention will now be described with reference to the accompanying drawings, in which.

Corresponding reference characters indicate corresponding components throughout the drawings.

DETAILED DESCRIPTION OF PREFERRED EMBODIMENTS

Figure 1A:
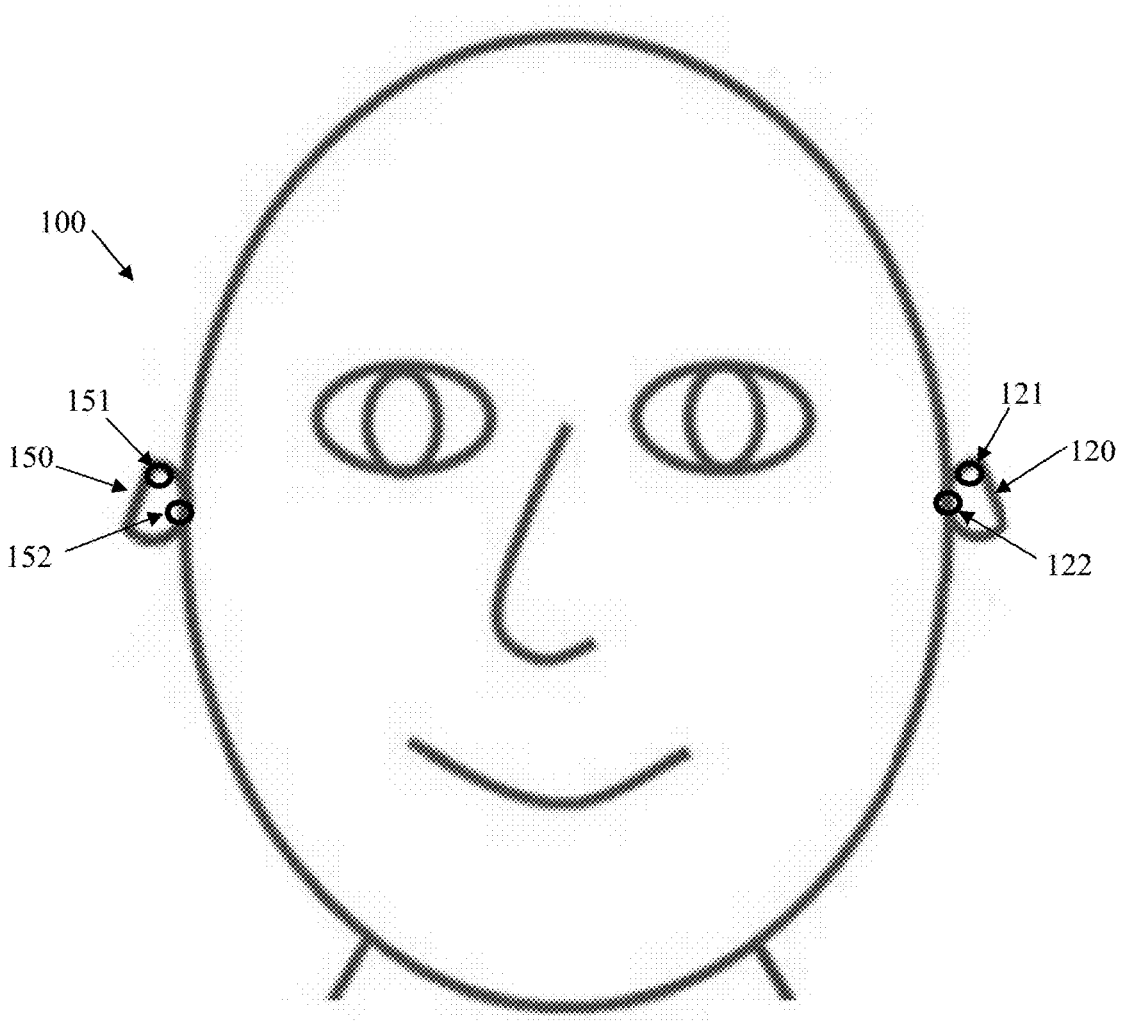
FIG. 1*a* and FIG. 1*b* illustrate a signal processing system comprising a wireless earbuds headset, in which on ear detection is implemented.
Figure 1B:
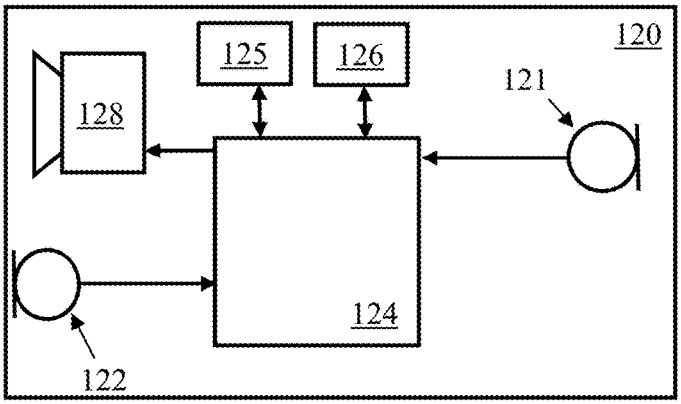

FIGS. 1*a* and 1*b* illustrate an ANC headset 100 in which on ear detection is implemented. Headset 100 comprises two wireless earbuds 150 and 120, each comprising two microphones 151, 152 and 121, 122, respectively. FIG. 1*b* is a system schematic of earbud 120. Earbud 150 is configured in substantially the same manner as earbud 120 and is thus not separately shown or described. A digital signal processor 124 of earbud 120 is configured to receive microphone signals from earbud microphones 121 and 122. Microphone 121 is a reference microphone and is positioned so as to sense ambient noise from outside the ear canal and outside of the earbud. Conversely, microphone 122 is an error microphone and in use is positioned inside the ear canal so as to sense acoustic sound within the ear canal including the output of speaker 128. When earbud 120 is positioned within the ear canal, microphone 122 is occluded to some extent from the external ambient acoustic environment. Headset 100 is configured for a user to listen to music or audio, to make telephone calls, and to deliver voice commands to a voice recognition system, and other such audio processing functions.

Processor 124 is further configured to adapt the handling of such audio processing functions in response to one or both earbuds being positioned on the ear, or being removed from the ear. Earbud 120 further comprises a memory 125, which may in practice be provided as a single component or as multiple components. The memory 125 is provided for storing data and program instructions. Earbud 120 further comprises a transceiver 126, which is provided for allowing the earbud 120 to communicate wirelessly with external devices, including earbud 150. Such communications between the earbuds may alternatively comprise wired communications in alternative embodiments where suitable wires are provided between left and right sides of a headset, either directly such as within an overhead band, or via an intermediate device such as a smartphone. Earbud 120 further comprises a speaker 128 to deliver sound to the ear canal of the user. Earbud 120 is powered by a battery and may comprise other sensors (not shown).

Figure 2:
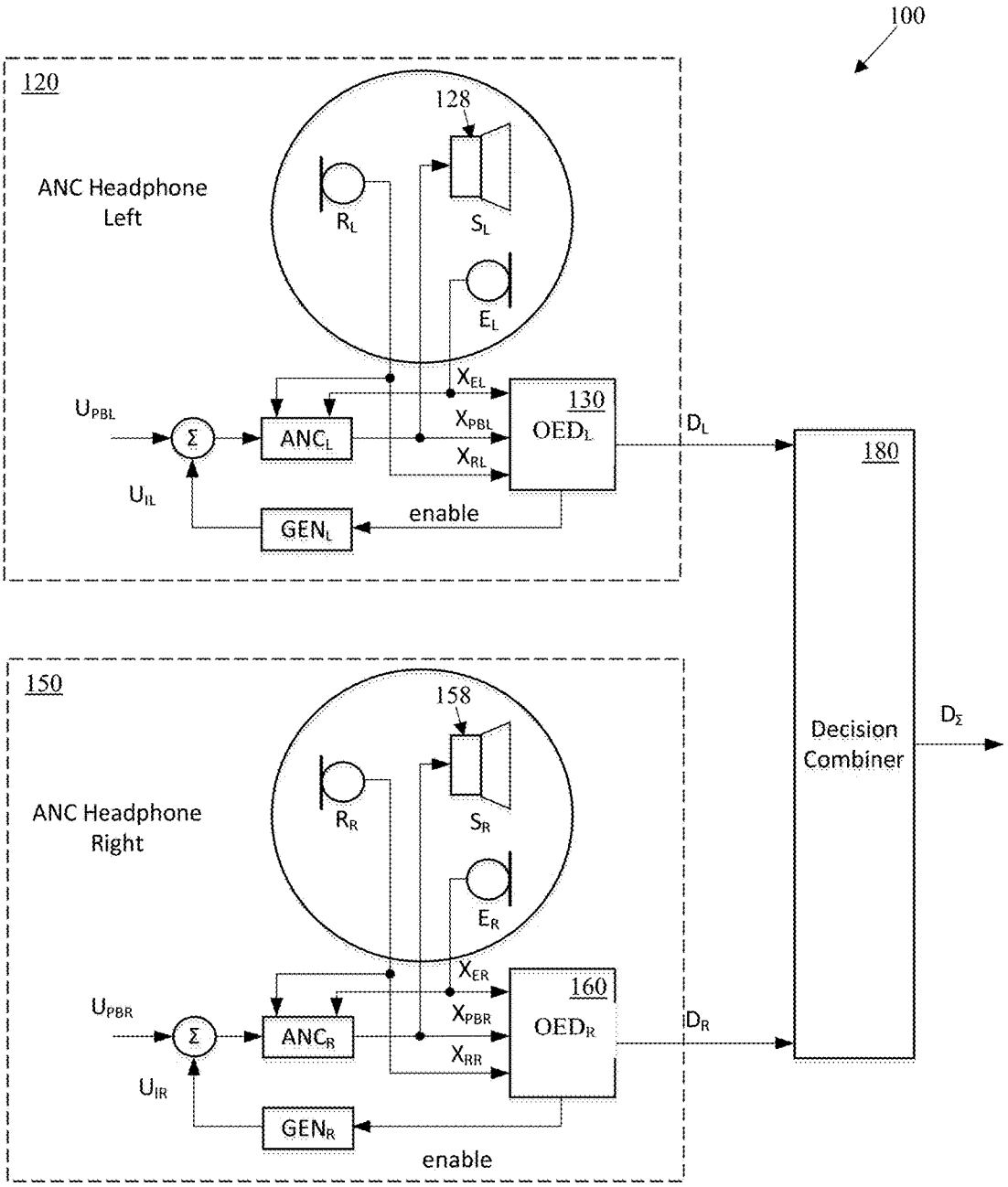
FIG. 2 is a generalized schematic of an ANC headset with the proposed on ear detector.

FIG. 2 is a generalized schematic of the ANC headset 100, illustrating in more detail the process for on ear detection in accordance with an embodiment of the present invention. In the following, the left reference microphone 121 is also denoted $R_L$, while the right reference microphone 151 is also denoted $R_R$. The left and right reference microphones respectively generate signals $X_{RL}$ and $X_{RR}$. The left error microphone 122 is also denoted $E_L$, while the right error microphone 152 is also denoted $E_R$, and these two error microphones respectively generate signals $X_{EL}$ and $X_{ER}$. The left earbud speaker 128 is also denoted $S_L$, and the right earbud speaker 158 is also denoted $S_R$. The left earbud playback audio signal is denoted $U_{PBL}$, and the right earbud playback audio signal is denoted $U_{PBR}$.

In accordance with the present embodiment of the invention, processor 124 of earbud 120 executes an on ear detector 130, or $OED_L$, in order to acoustically detect whether the earbud 120 is on or in the ear of the user. Earbud 150 executes an equivalent $OED_R$ 160. In this embodiment, the output of the respective on ear detector 130, 160 is passed as an enable or disable signal to a respective acoustic probe generator $GEN_L$, $GEN_R$. When enabled, the acoustic probe generator creates an inaudible acoustic probe signal $U_{IL}$, $U_{IR}$, to be summed with the respective playback audio signal. The output of the respective on ear detector 130, 160 is also passed as a signal $D_L$, $D_R$ to a Decision Combiner 180 which produces an overall on ear decision $D_\Sigma$.

In the following passages, i=L [left] or R [right]. As shown in FIG. 2, each headphone is equipped with a speaker, $S_i$, a reference microphone, $R_i$, and an error microphone, $E_i$. To playback signal $U_{PBi}$, from a host playback device, there may be added an inaudible probe signal, $U_{Ii}$, depending on the value of the "enable" flag from the Control module: 1-add the probe; 0—do not add the probe. The inaudible probes, $U_{Ii}$, are generated by corresponding probe generators, $GEN_i$. A particular value of the "enable" flag, 0 or 1, depends on factors such as the device's operational environment conditions, ambient noise level, presence of playback, headset design, and other such factors. The resulting signal passes through the $ANC_i$, which provides the usual ANC function of adding a signal which constitutes a certain amount of estimated unwanted noise in antiphase. To this end, the $ANC_i$ takes inputs from the reference microphone, $R_i$ and error microphone, $E_i$. The output of the $ANC_i$ is then passed to the speaker $S_i$ to be played into the ear of the user. The output from the speaker generates signal $X_{Ri}$ which contains a certain amount of uncompensated noise in the i-th reference microphone; similarly, it generates signal $X_{Ei}$ in the i-th error microphone.

Figure 3:
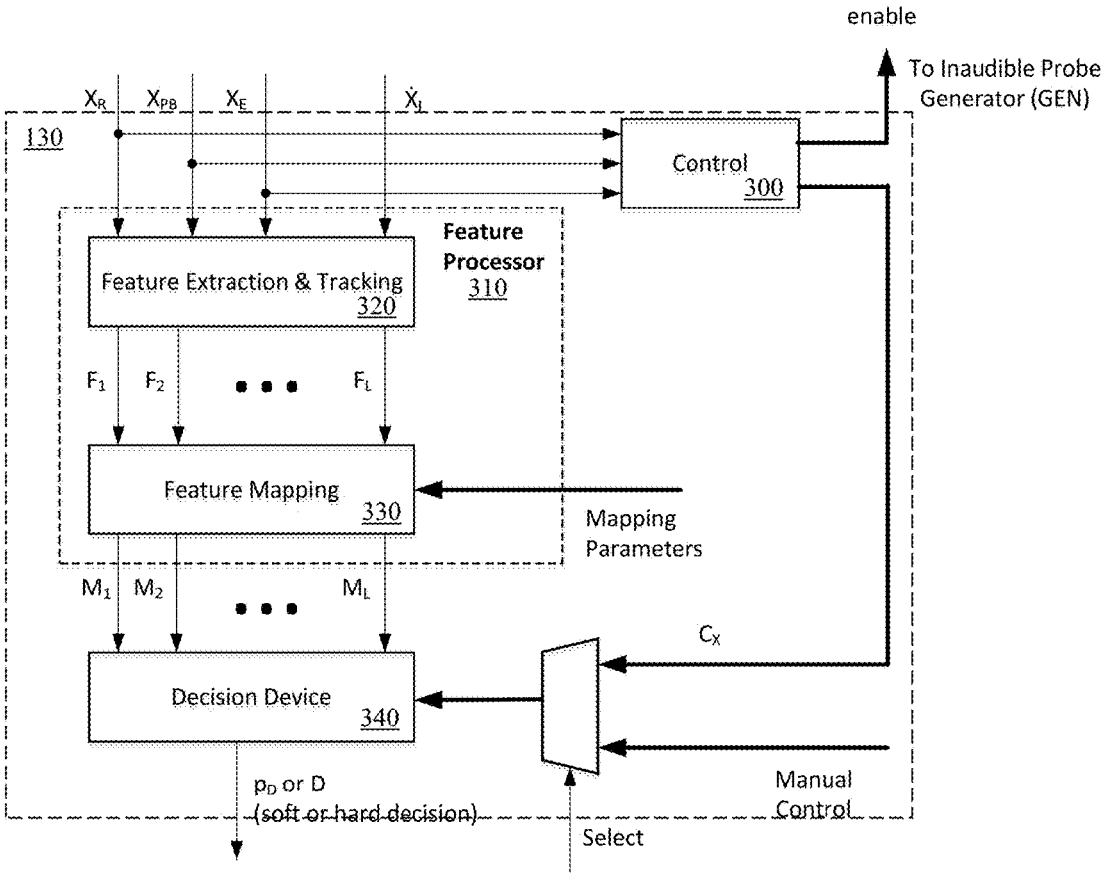
FIG. 3 is a block diagram of the on ear detector utilized in each headset of FIG. 2.

FIG. 3 is a generalized block diagram of the on ear detection module 130 in accordance with the present embodiment of the present invention. The signals $X_{Ei}$, $X_{Ri}$, and $X_{PBi}$ are fed into the i-th on ear detection module ($OED_i$ 130) where these input signals are analysed, and an i-th decision, $D_i$, is made as to whether the headphone is on ear or off ear. The individual decisions, $D_i$, from modules 130 & 160 may be used independently or combined (e.g. ANDed) in the Decision Combiner 180 to produce the overall on-/off-ear decision flag, $D_\Sigma$. It should be noted, that $U_{PBi}$ may be fed into the $OED_i$ instead of $X_{PBi}$ if it is desirable for the anti-noise ANC signal not to be included in on-ear detection analysis.

If enabled, the inaudible probe generator $GEN_i$ generates an inaudible probe signal, which is used for OED when other features are found to be unreliable by the Control module 300. The inaudible probe signal is made to be inaudible by ensuring that its spectral content, $B_{IPS}$, is situated below a suitable threshold considered to be the lower limit of the human audible frequency range. In this case 20 Hz>$B_{IPS}$.

The inaudible probe may be a continuous stationary signal or its parameters may vary with time. The properties of the probe signal (e.g. frequency, phase, amplitude, spectral shape) may be varied depending on a preconfigured sequence or in response to the signals on the other sensors. For example, if the Control module 300 determines that there is a large amount of ambient activity at the same frequencies as the probe, the probe may be correspondingly adjusted to occur at quieter frequencies in order to improve on ear detection.

As shown in FIG. 2 the inaudible probe $U_{Ii}$ is added to the playback signal $U_{PBi}$. A playback signals are usually band limited to the human audible spectrum, spectral components of the probe $U_{Ii}$ and the playback $U_{PBi}$ do not overlap in the frequency domain. For example, if the inaudible probe is a tone with frequency $f_o$=20 Hz, then to ensure no overlap, the playback signal can be filtered with a high-pass filter, HPF, with the cut-off frequency slightly larger than $f_o$ in order to prevent spectral overlap on one hand, and prevent the playback sounding too "tinny" (lacking in low frequency components) on the other hand. In such embodiments, it is further appropriate to extract the inaudible probe, $\hat{X}_{Ii}$ from the error microphone signal, $X_{Ei}$, by passing $X_{Ei}$ through a low-pass filter having a cut-off frequency equal to or slightly larger than $f_o$.

Returning to FIG. 3, it is noted that OED 130 is for a single earbud/earphone, and the i index is omitted for the sake of simplicity. The signals from the reference microphone, the playback module, and error microphone, $X_{R,\ PB,\ EI}$, respectively and extracted inaudible probe, $\hat{X}_I$, are fed into the Feature Extraction module, FE 320, which is the first stage of the Feature Processor, FP 310. In FE 320, a total of L selected features $F_k$, k=1 . . . L with L being the total number of features, are extracted, as discussed further in the following.

The features $F_k$ may be of different nature, may be measured in different units, and some or all may also contain significant outliers. Reflecting the aim of the present invention of dynamically considering a plurality of such features, the Feature Mapping module, FM 330, being the second stage of the FP 310, is used to "squash" or compress the features $F_k$ into normalized unit-less features, $M_k$. In this embodiment, $M_k \in [0, 1]$, k=1, . . . , L. It is to be noted that each feature, $F_k$, is mapped to $M_k$ using a corresponding set of parameters which pertain to that respective feature only.

The normalized unit-less features, $M_k$, output by FM 330 are input into Decision Device, DD 340, where a "soft" non-binary decision, $p_D$, is made as to whether the headset is on ear or off ear. The "soft" (unsliced) decision, $p_D$ represents the probability of headphones being on ear. The soft decision, $p_D$, may be sliced or thresholded to obtain a "hard" binary decision, D, as to whether the headset is on ear or off ear. Decision combiner 180 may receive the soft decision, $p_D$, and/or "hard" binary decision, D, from both ears. Decision Combiner 180 may be a module executed in either of the earbuds 120, 150, and/or in an associated device such as a smartphone.

Referring again to FIG. 3, the overall on ear detection process of $OED_L$ 130 is guided by the control module 300 which is configured to enable and disable generation and injection of the inaudible probe signal, and to define the inaudible probe signal type (e.g. frequency components, amplitude). Control module 300 is further configured to provide data necessary for the decision device 340 to emphasise or de-emphasise the relative contribution of each respective extracted feature towards the overall on-ear decision. This is an important aspect of the present invention, as combining the contribution of multiple signal features into a single on-ear decision has been found to improve robustness and decision accuracy. The decision device 340 may be controlled in an automated and adaptive manner by variable weights contained in the output $C_X$ of the Control module 300. Alternatively the decision device 340 may be controlled to apply a set of pre-selected weights provided via the "Manual Control" input shown in FIG. 3, to statically emphasise or de-emphasise the relative contribution of each respective extracted feature towards the overall on-ear decision. The $OED_L$ 130 may switch between adaptive weightings and static weightings, under control of the "Select" input shown in FIG. 3, which may for example be activated by control module 300, or by another module.

Figure 4:
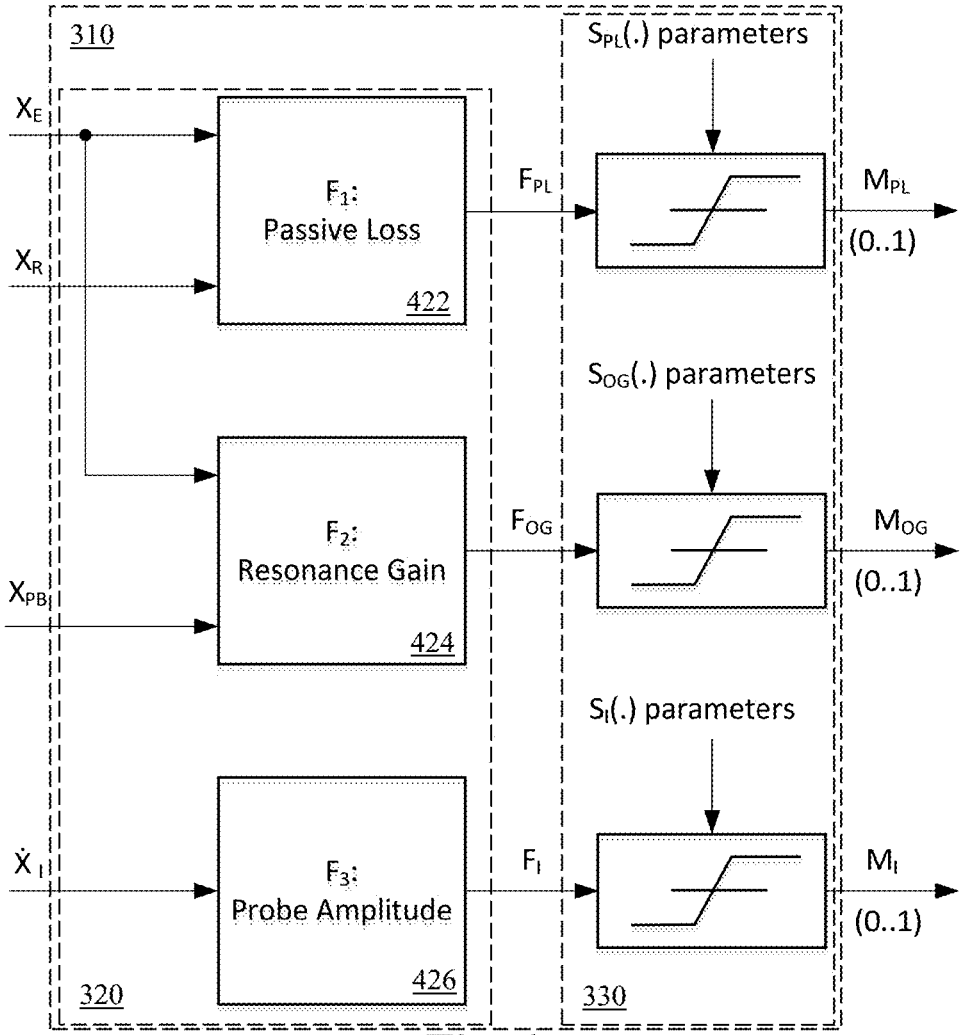
FIG. 4 illustrates a feature processor suitable for use in the on ear detector of FIG. 3, in accordance with one embodiment of the invention.

FIG. 4 illustrates the feature processor 310 of FIG. 3 in greater details. In this embodiment, the feature extraction and tracking module 320 is configured to extract three features from the microphone signals. Feature extraction module $F_1$ 422 takes as inputs the error mic and reference mic signals $X_E$ and $X_R$ to produce feature $F_{PL}$, being a passive loss signal feature. Feature extraction module $F_2$ 424 takes as inputs the error mic and playback signals $X_E$ and $X_{PB}$ to produce feature $F_{OG}$, being an occlusion gain signal feature. Feature extraction module $F_3$ 426 takes as an input the filtered inaudible probe signal $X_I$ to produce feature $F_I$, being a probe amplitude signal feature. Each feature is measured repeatedly over time and the signal feature measures are used to determine whether the headset is on ear. These features are discussed in further detail in the following.

The Passive Loss feature, which can also be considered as an insertion loss feature, is defined as the attenuation in an external sound level. The external sound level is experienced by the reference mic 121 regardless of whether the headset is on ear or off ear, whereas less ambient sound leaks into the error mic 122 when the earbud 120 is on ear and is blocking or occluding the ear canal. This feature can thus provide one means for on ear detection. The passive loss signal feature $F_{PL}$ in this embodiment is defined as follows:

$$F_{PL} = \frac{P_E^{B1}}{P_R^{B1}}, \tag{1}$$

where $P_E^{B1}$ is the power of the signal from the error microphone 122, and $P_R^{B1}$ is the power of the signal from the reference microphone 121, calculated over a band $B_1=[f_1^{PL}, f_2^{PL}]$. Corner frequencies $f_1^{PL}$, $f_2^{PL}$ are likely to differ for various headphone designs. Typical corner frequencies are $f_1^{PL}$=1.4 kHz and $f_2^{PL}$=3.7 kHz which may be extended in real time based on the current state of the system (e.g. if ANC is on, $f_1^{PL}$=20 Hz in order to include active attenuation). The Passive Loss feature $F_{PL}$ produced by module 422 is most useful as an on-ear indication when the ambient noise is loud and the headphone playback is quiet or absent. Accordingly, in this embodiment the ambient noise level and playback level are determined in the control module 300, and are used to weight the Passive Loss feature $F_{PL}$ accordingly.

Feature extraction module $F_2$ 424 produces a feature $F_{OG}$, being an occlusion gain signal feature. This feature seeks to exploit the increase in sound level which occurs when the earbud is on ear, due to the fact that less of the played back sound from the speaker escapes from the blocked ear. Feature $F_{OG}$ is defined as follows:

$$F_{OG} = \frac{P_E^{B2}}{P_{PB}^{B2}}, \tag{2}$$

where $P_E^{B2}$ is the power of the signal from the error microphone, and $P_{PB}^{B2}$ is the power of the playback signal, each calculated over a band $B_2=[f_1^{OG}, f_2^{OG}]$ Again, corner frequencies $f_1^{OG}$, $f_2^{OG}$ are likely to differ for various headphone designs. Typical corner frequencies are $f_1^{OG}$=0.1 kHz and $f_2^{OG}$=2.5 kHz. The Occlusion Gain feature $F_{OG}$ is most useful as an on-ear indication when the ambient noise is quiet and headphone playback is present. Accordingly, in this embodiment the ambient noise level and playback level are determined in the control module 300, and are used to weight the Occlusion Gain feature $F_{OG}$ accordingly.

Feature extraction module $F_3$ 426 produces a feature $F_I$, being a probe amplitude signal feature. In this embodiment the observed amplitude of the inaudible probe signal $X_I$ is defined to be the maximum of the absolute value of $X_I$. A harmonic tone or multi-tone signal $U_I$ of a pre-defined amplitude, $A_I$, is used as the inaudible probe, for example an amplitude which produces ~60 dB SPL at the speaker output. In other embodiments, any suitable method may be used to estimate the amplitude of the probe signal and/or components thereof, $\hat{A}_I$, such alternative methods including spectral analysis, state estimation such as Kalman filtering, and the like. In particular it is to be noted that state estimation such as Kalman filtering will only track parameters of a signal that is intended to be followed, based on the filter's internal space-state model, and is thus advantageously robust to wind noise or any low frequency sound that is different from the filter's internal signal. This feature $F_I$ seeks to exploit the increase in sound level which occurs when the earbud is on ear, due to the fact that less sound escapes from the blocked ear. Using inaudible probe $U_I$ is advantageous because the probe amplitude can be monitored continuously even when the playback signal $U_{PB}$ is zero or quiet. Additionally, using an inaudible probe is particularly suitable for headsets having a close fit design to the user's anatomy, providing effective occlusion of external sounds as observed within the headset.

It is to be noted that alternative embodiments of the invention may select a partly or entirely different set of signal features for on ear detection. In accordance with the present invention, it is the normalisation and weighting of two or more such features which is of primary note, as discussed further below. In this regard, referring again to FIG. 4, the feature measures $F_{PL}$, $F_{OG}$ and $F_I$ are passed from feature extraction and tracking module 320 to feature mapping module 330. In feature mapping module 330, the Passive Loss feature $F_{PL}$ is mapped into a normalized unit-less feature, $M_{PL}$, by applying a sigmoid function as follows:

$$M_{PL}=S(F_{PL},k_{PL},F_{PL}^0) \tag{3}$$

where $k_{PL}$ is the slope, and $F_{PL}^0$ is the midpoint of the logistic sigmoid. Both $k_{PL}$ and $F_{PL}^0$ are chosen empirically.

In (3) S(•) is a logistic sigmoid function with slope (steepness) k and midpoint $x_0$ such that:

$$S(x, k, x_0) = \frac{1}{1 + e^{-k(x-x_0)}}, \tag{4}$$

Similarly, feature mapping module 330 maps $F_{OG}$ to a normalized unit-less feature $M_{OG}$ as follows:

$$M_{OG}=S(F_{OG},k_{OG},F_{OG}^0) \tag{5}$$

where $k_{OG}$ is the slope, and $F_{OG}^0$ is the centre of the respective logistic sigmoid. Both $k_{OG}$ and $F_{OG}^0$ are chosen empirically.

And, feature mapping module 330 maps $F_I$ to a normalized unit-less feature $M_I$ as follows.

$$M_I=S(F_I,k_I,F_I^0) \tag{6}$$

where $k_I$ is the slope, and $F_I^0$ is the centre of the logistic sigmoid, $S_I(\bullet)$. Both $k_I$ and $F_I^0$ are chosen empirically.

A key issue to note in relation to the non-linear mapping adopted by the present embodiment of the invention is that the various signal features are at first measured on different scales, in different units. To normalise such measures from varied scales to a common normalized scale is a key enabler of the decision device 340.

Returning again to FIG. 3, control module 300 is supplied with signals $X_{Ei}$, $X_{Ri}$, and $X_{PBi}$, and estimates their corresponding short-term powers, $P_{Ei}$, $P_{Ri}$, and $P_{PBi}$ using any convenient method. The calculated powers are used to produce error microphone, reference microphone, and playback signal presence indicators (SPI), $C_{Ei}$, $C_{Ri}$, and $C_{PBi}$, respectively as follows:

$$C_{Xi}=S(P_{Xi},k_{Xi},v_{Xi}), \tag{7}$$

where X={E, R, or PB}, i={L[eft] or R[ight]}, and S(•) is a logistic sigmoid function with slope $k_{Xi}$ and midpoint $v_{Xi}$ as per (4). Parameters of the sigmoid, $k_{Xi}$ and midpoint $v_{Xi}$, are empirically chosen such that $C_{Xi}$ is close to zero when $X_{Xi}$ is low, and $C_{Xi}$ is close to 1 when $X_{Xi}$ is high.

A choice of a detection metric and enabling/disabling generation and injection of the inaudible probe signal by the control module 300 is based on the SPI, $C_{Ei}$, $C_{Ri}$, and $C_{PBi}$, (0—low, 1—high) as summarised in Table 1.

TABLE 1

| $C_{Ei}$ | $C_{Ri}$ | $C_{PBi}$ | | Control Signal | Meaning |
|---|---|---|---|---|---|
| 0 | 0 | 0 | 0 | "Inject Inaudible Probe" | No audio is present for analysis - play the probe. |
| 0 | 0 | 1 | 1 | "Check Error Mic" | Playback is present but is not registered on the error microphone |

TABLE 1-continued

| $C_{Ei}$ | $C_{Ri}$ | $C_{PBi}$ | | Control Signal | Meaning |
|---|---|---|---|---|---|
| 0 | 1 | 0 | 2 | "Use Passive Loss" | Playback is low, ambient noise is high - use or prefer Passive Loss |
| 0 | 1 | 1 | 3 | "Check Error Mic" | Playback is present but is not registered on the error microphone |
| 1 | 0 | 0 | 4 | "Inject Inaudible Probe" | Own voice is present - play the probe |
| 1 | 0 | 1 | 5 | "Use Occlusion Gain" | Playback is present and is registered on the error microphone; ambient noise is low - use or prefer Occlusion gain |
| 1 | 1 | 0 | 6 | "Inject Inaudible Probe" | Own voice is present; ambient noise is high - play the probe |
| 1 | 1 | 1 | 7 | "Inject Inaudible Probe" | All inputs are high - play the probe |

Note, that states 1 and 3 in Table 1 represent headset abnormal behaviour: playback is present but no signal is registered on the error microphone. This may indicate a faulty error microphone or speaker. Thus these states are excluded from a list of "allowed" states.

The control signal (0-7) and the signal presence indicators, $C_{Ei}$, $C_{Ri}$, and $C_{PBi}$, comprise the output $C_X$ of the Control module.

Figure 5:
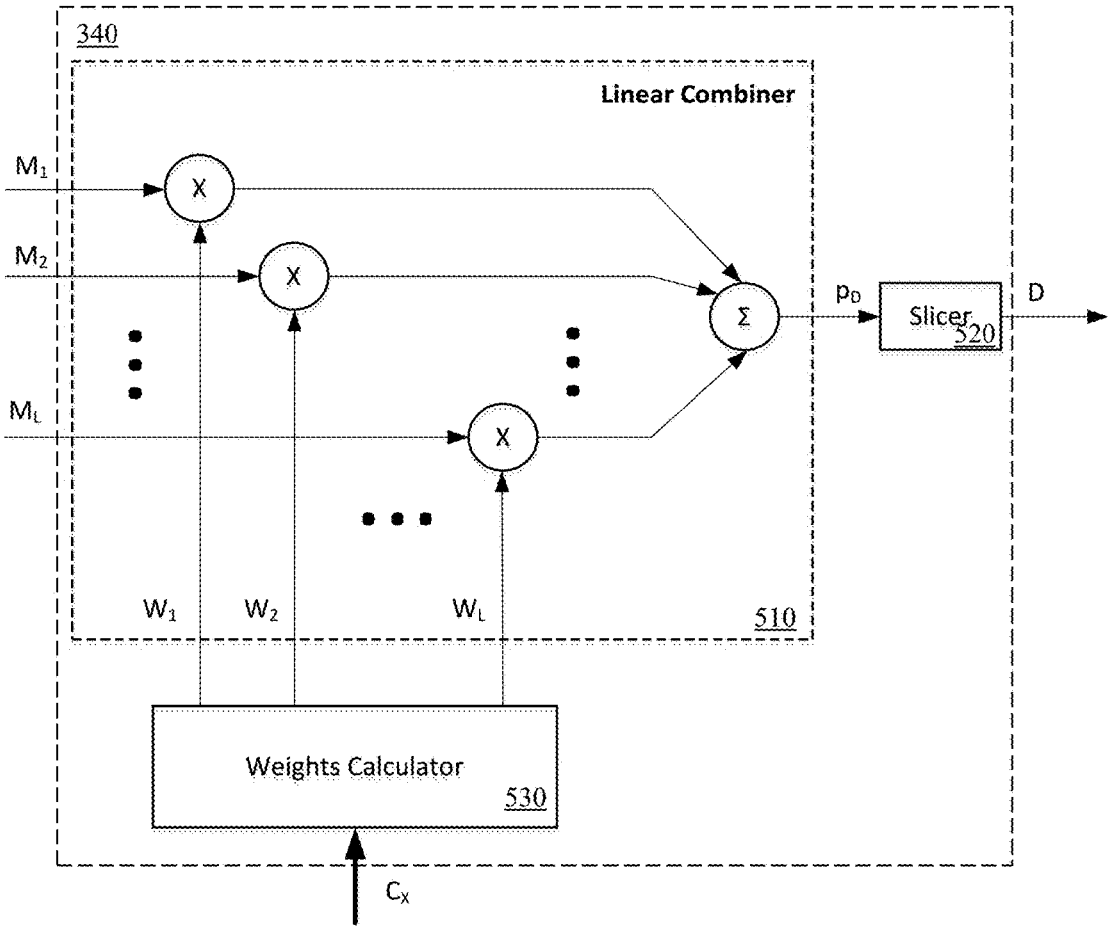
FIG. 5 is a block diagram of a decision device suitable for use in the on ear detector of FIG. 3, in accordance with one embodiment of the invention.

FIG. 5 is a block diagram of the Decision Device 340. In this embodiment the decision device 340 consists of Linear Combiner 510, an optional Slicer 520, and Weights Calculator 530. Decision device receives the normalized unit-less features $M_k$, k=1, . . . , L from feature mapping 330, which are multiplied by respective corresponding weights, $w_k$, k=1, . . . , L provided by weights calculator 530 in the linear combiner 510. The results of each multiplication are added together in order to produce a "soft" (unsliced) decision, $p_D$, which is the output of linear combiner 510. The "soft" decision, $p_D$, may be optionally sliced or thresholded by Slicer 520, to generate a binary decision, D, as follows:

$$p_D = \frac{1}{L}\sum_{k=1}^{L} w_k M_k, \tag{8}$$

$$D = \begin{cases} 0, & p_D < T_D \\ 1, & p_D \geq T_D \end{cases}, \tag{9}$$

where $T_D$ is the (hard) decision threshold of the Slicer.

The weights are applied to the normalized unit-less metrics as per (8) in order to produce a probability of the respective earbud 120 being on-ear, $p_D$. If a binary decision is required, the probability $p_D$ may be sliced as per (9).

The weights represented by a weight vector, $\vec{w}=\{w_k\}$, k=1, . . . , L, may either be calculated automatically in the Weight Calculator 530 based on the Control module outputs, $C_{Ei}$, $C_{Ri}$, and $C_{PBi}$, or the weights may be manually set based on preference. For example if only the amplitude of the inaudible probe is to be used for in-ear detection then the weights may be manually set to $\vec{w}=\{0\ 0\ 1\}$.

An example of weight calculations by Weight Calculator 530 in accordance with the present embodiment is given below. Weight $w_1$ is calculated as follows:

Feature $M_1=M_{PL}$—normalized unit-less Passive Loss

Control signal 2: "Use Passive Loss"

$w_1=C_R\cdot(1-C_{PB})$

Corner Cases:

$w_1$=1: Playback is quiet ($C_{PB}$—low) and ambient noise is loud ($C_R$—high). Passive Loss feature is fully utilized.

$w_1$=0: Playback is loud ($C_{PB}$—high) and ambient noise is low/absent ($C_R$—low). Passive Loss feature has no impact on the overall decision.

Weight $w_2$ is calculated as follows:

Feature $M_2=M_{RG}$—normalized unit-less Occlusion Gain

Control signal 5: "Use Occlusion Gain"

$w_2=(1-C_R)\cdot C_{PB}$

Corner Cases:

$w_2$=1: Ambient noise is absent ($C_R$—low) and playback is loud ($C_{PB}$—high). Occlusion Gain feature is fully utilized.

$w_2$=0: Ambient noise level is high ($C_R$—high) and playback is not present/low ($C_{PB}$—low). Occlusion Gain feature has no impact on the overall decision.

As $M_I$=1 when the estimated probe signal amplitude reaches its expected level, and $M_I$=0 when the estimated probe signal amplitude approaches zero, the dedicated weight, $w_3$, is not required for further control of the contribution of $M_I$ into the overall decision by decision device 340. However, the weight $w_3$ is useful for system-level control. To this end, weight $w_3$ is calculated as follows:

Feature $M_3=M_I$—normalized unit-less amplitude of the inaudible probe signal

Control signal 0, 4, 6, 7: "Inject Inaudible Probe"

$w_3$=1: if $M_3$ is enabled manually, or, alternatively, if both $w_1$ and $w_2$ are low. Amplitude of the inaudible probe signal feature is fully utilized.

$w_3$=0: If $M_3$ is disabled manually. Amplitude of the inaudible probe signal has no impact on the overall decision.

The present embodiment of the invention further provides for averaged or smoothed hysteresis in changing the decision of whether the headset is on ear or off ear. In particular, only after the decision device indicates that the headset is on ear for more than 1 second is the state indication changed from off ear to on ear. Similarly, only after the decision device indicates that the headset is off ear for more than 3 seconds is the state indication changed from on ear to off ear.

Preferred embodiments also provide for automatic turn off of the OED 130 once the headset has been off ear for more than 5 minutes (or any suitable comparable period of time). This allows OED to provide a useful role when the headsets are in regular use and regularly being moved on ear, but also allows the headset to conserve power when off ear for long periods, after which the OED 130 can be reactivated when the device is next powered up or activated for playback.

The present embodiment thus provides for automatic or manual application-specific relative weighting of selected detection features. The variable weighting is made in response to detected signal conditions, so that the system responds to the use context of the headset, environmental conditions and/or demonstrates a level of situational awareness. Dynamic adjustment of the parameters (e.g. amplitude and frequency, spectral shape etc.) of the inaudible probe signals is also provided in response to the changing environment, headset design, and the like.

Embodiments of the invention may comprise a USB headset having a USB cable connection effecting a data connection with, and effecting a power supply from, a master device. The present invention, in providing for in ear detection which requires only acoustic microphone(s) and acoustic speaker(s), may be particularly advantageous in such embodiments, as USB earbuds typically require very small componentry and have a very low price point, motivating the omission of non-acoustic sensors such as capacitive sensors, infrared sensors, or optical sensors. Another benefit of omitting non-acoustic sensors is to avoid the requirement to provide additional data and/or power wires in the cable connection which must otherwise be dedicated to such non-acoustic sensors. Providing a method for in-ear detection which does not require non-acoustic components is thus particularly beneficial in this case.

Other embodiments of the invention may comprise a wireless headset such as a Bluetooth headset having a wireless data connection with a master device, and having an onboard power supply such as a battery. The present invention may also offer particular advantages in such embodiments, in avoiding the need for the limited battery supply to be consumed by non-acoustic in ear sensor componentry.

The present invention thus seeks to address on ear detection by acoustic means only, that is by using the extant speaker/driver, error microphone(s) and reference microphone(s) of a headset.

Knowledge of whether the headset is on ear can in a simple case be used to disable or enable one or more signal processing functions of the headset. This can save power. This can also avoid the undesirable scenario of a signal processing function adversely affecting device performance when the headset is not in an expected position, whether on ear or off ear. In other embodiments, knowledge of whether the headset is on ear can be used to revise the operation of one or more signal processing or playback functions of the headset, so that such functions respond adaptively to whether the headset is on ear.

The skilled person will thus recognise that some aspects of the above-described apparatus and methods, for example the calculations performed by the processor may be embodied as processor control code, for example on a non-volatile carrier medium such as a disk, CD- or DVD-ROM, programmed memory such as read only memory (firmware), or on a data carrier such as an optical or electrical signal carrier. The logic of Table 1 may be implemented in general purpose memory 125 of the earbuds, or by way of a look up table, or by any such suitable means. For many applications, embodiments of the invention will be implemented on a DSP (Digital Signal Processor), ASIC (Application Specific Integrated Circuit) or FPGA (Field Programmable Gate Array). Thus the code may comprise conventional program code or microcode or, for example, code for setting up or controlling an ASIC or FPGA. The code may also comprise code for dynamically configuring re-configurable apparatus such as re-programmable logic gate arrays. Similarly the code may comprise code for a hardware description language such as Verilog TM or VHDL (Very high speed integrated circuit Hardware Description Language). As the skilled person will appreciate, the code may be distributed between a plurality of coupled components in communication with one another. Where appropriate, the embodiments may also be implemented using code running on a field-(re)programmable analogue array or similar device in order to configure analogue hardware.

Embodiments of the invention may be arranged as part of an audio processing circuit, for instance an audio circuit which may be provided in a host device. A circuit according to an embodiment of the present invention may be implemented as an integrated circuit.

Embodiments may be implemented in a host device, especially a portable and/or battery powered host device such as a mobile telephone, an audio player, a video player, a PDA, a mobile computing platform such as a laptop computer or tablet and/or a games device for example. Embodiments of the invention may also be implemented wholly or partially in accessories attachable to a host device, for example in active speakers or headsets or the like. Embodiments may be implemented in other forms of device such as a remote controller device, a toy, a machine such as a robot, a home automation controller or the like.

It should be noted that the above-mentioned embodiments illustrate rather than limit the invention, and that those skilled in the art will be able to design many alternative embodiments without departing from the scope of the appended claims. The use of "a" or "an" herein does not exclude a plurality, and a single feature or other unit may fulfil the functions of several units recited in the claims. Any reference signs in the claims shall not be construed so as to limit their scope.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

The invention claimed is:

1. A signal processing device for on ear detection for a headset, the device comprising:

a plurality of inputs for receiving respective microphone signals from a plurality of microphones; and a processor configured to derive from the microphone signals a plurality of signal feature measures, the processor further configured to normalise the signal feature measures by applying a non-linear mapping of each signal feature measure to a unitless reference scale; the processor further configured to variably weight the signal feature measures in response to detected signal conditions in the microphone signals; the processor further configured to combine the variably weighted normalized signal feature measures to produce an output indication of whether a headset is on ear.

2. The signal processing device of claim 1 wherein the detected signal conditions comprise signal presence indicators respectively indicating whether a signal is present on the microphone signals.

3. The signal processing device of claim 1 wherein the plurality of signal feature measures comprises a signal feature reflecting passive loss, being the attenuation in an external sound level or a signal feature reflecting occlusion gain, being the increase in sound level which occurs when the earbud is on ear.

4. The signal processing device of claim 1 wherein the processor is configured to create an inaudible acoustic probe signal for playback.

5. The signal processing device of any one of claim 1, further comprising a control module which is configured to select a weighting to be applied to the signal feature measures based on the detected signal conditions in the microphone signals.

6. The signal processing device of any one of claim 1, further comprising a memory storage storing predefined signal feature weightings to be applied to the signal features measures, each predefined signal feature weighting corresponding to a respective detected signal condition.

7. The signal processing device of claim 1 further comprising a linear combiner for multiplying the signal feature measures by respective variable weights.

8. The signal processing device of claim 1 wherein the processor is configured to alter at least one signal processing function in response to a determination that the headset is not on ear.

9. A method for on ear detection for a headset, the method comprising:

receiving respective microphone signals from a plurality of microphones;

deriving from the microphone signals a plurality of signal feature measures;

normalising the signal feature measures by applying a non-linear mapping of each signal feature measure to a unitless reference scale;

variably weighting the signal feature measures in response to detected signal conditions in the microphone signals; and combining the variably weighted normalized signal feature measures to produce an output indication of whether a headset is on ear.

10. The method of claim 9 wherein the detected signal conditions comprise signal presence indicators respectively indicating whether a signal is present on the microphone signals.

11. The method of claim 9 wherein the plurality of signal feature measures comprises a signal feature reflecting passive loss, being the attenuation in an external sound level or a signal feature reflecting occlusion gain, being the increase in sound level which occurs when the earbud is on ear.

12. The method of claim 9 further comprising creating an inaudible acoustic probe signal for playback.

13. The method of claim 9 further comprising selecting a weighting to be applied to the signal feature measures based on the detected signal conditions in the microphone signals.

14. The method of claim 9 further comprising retrieving signal feature weightings to be applied to the signal features measures from a memory storage storing predefined signal feature weightings each corresponding to a respective detected signal condition.

15. The method of claim 9 wherein the combining comprises summing the products of the signal feature measures with the respective variable weights to produce a soft decision whether a headset is on ear.

16. A non-transitory computer readable medium for on ear detection for a headset, comprising instructions which, when executed by one or more processors, causes performance of the following:

receiving respective microphone signals from a plurality of microphones;

deriving from the microphone signals a plurality of signal feature measures;

normalising the signal feature measures by applying a non-linear mapping of each signal feature measure to a unitless reference scale;

variably weighting the signal feature measures in response to detected environmental conditions in the microphone signals; and combining the variably weighted normalized signal feature measures to produce an output indication of whether a headset is on ear.

17. A system for on ear detection for a headset, the system comprising a processor and a memory, the memory containing instructions executable by the processor and wherein the system is operative to:

receive respective microphone signals from a plurality of microphones;

derive from the microphone signals a plurality of signal feature measures;

normalise the signal feature measures by applying a non-linear mapping of each signal feature measure to a unitless reference scale;

variably weight the signal feature measures in response to detected signal conditions in the microphone signals; and combine the variably weighted normalized signal feature measures to produce an output indication of whether a headset is on ear.

18. The system of claim 17, wherein the system is a headset or an earbud or a smartphone.

19. A signal processing device for on ear detection for a headset, the device comprising:

a plurality of inputs for receiving respective microphone signals from a plurality of microphones; and a processor configured to derive from the microphone signals a plurality of signal feature measures, the processor further configured to normalise the signal feature measures; the processor further configured to variably weight the signal feature measures in response to detected signal conditions in the microphone signals; the processor further configured to combine the variably weighted normalised signal feature measures to produce an output indication of whether a headset is on ear, wherein the processor is configured to select a weighting to be applied to the signal feature measures based on the detected signal conditions in the microphone signals.

20. A signal processing device for on ear detection for a headset, the device comprising:

a plurality of inputs for receiving respective microphone signals from a plurality of microphones;

a processor configured to derive from the microphone signals a plurality of signal feature measures, the processor further configured to normalise the signal feature measures; the processor further configured to variably weight the signal feature measures in response to detected signal conditions in the microphone signals; the processor further configured to combine the variably weighted normalised signal feature measures to produce an output indication of whether a headset is on ear; and a memory storage storing predefined signal feature weightings to be applied to the signal features measures, each predefined signal feature weighting corresponding to a respective detected signal condition.

21. A signal processing device for on ear detection for a headset, the device comprising:

a plurality of inputs for receiving respective microphone signals from a plurality of microphones;

a processor configured to derive from the microphone signals a plurality of signal feature measures, the processor further configured to normalise the signal feature measures; the processor further configured to variably weight the signal feature measures in response to detected signal conditions in the microphone signals; the processor further configured to combine the variably weighted normalised signal feature measures to produce an output indication of whether a headset is on ear; and a linear combiner for multiplying the signal feature measures by respective variable weights.

* * * * *